United States Patent [19]

Prunbauer et al.

[11] Patent Number: 4,669,284

[45] Date of Patent: Jun. 2, 1987

[54] LOCK CYLINDER WITH ROTATABLE MAGNETIC TUMBLERS

[75] Inventors: Kurt Prunbauer, Herzogenburg; Erich Csapo, Vienna, both of Austria

[73] Assignee: Evva - Werk Spezialerzeugung von Zylinder- und Sicherheitsschlossern Gesellschaft m.b.H & Co. Kommanditgesellschaft, Vienna, Austria

[21] Appl. No.: 782,493

[22] Filed: Oct. 1, 1985

[30] Foreign Application Priority Data

Oct. 4, 1984 [AT] Austria ..... 3151/84

[51] Int. Cl.[4] ..... E05B 47/00

[52] U.S. Cl. ..... 70/276; 70/365; 70/422

[58] Field of Search ..... 70/276, 413, 365, 409, 70/422

[56] References Cited

U.S. PATENT DOCUMENTS 4,220,021 9/1980 Burger ..... 70/365

FOREIGN PATENT DOCUMENTS 341901 6/1977 Austria .
357430 11/1979 Austria .
2197406 3/1974 France .

*Primary Examiner*—Robert L. Wolfe
*Attorney, Agent, or Firm*—Karl F. Ross; Herbert Dubno

[57] ABSTRACT

A lock cylinder comprises a cylinder housing and a cylinder core having at least one rotatable magnetic tumbler supported therein, in which at least one axially slidable locking element is provided. The locking element has projections thereon directed toward the exterior. The locking element has a contacting slider having contacting elements projecting toward the rotatable magnetic tumblers, and a locking slider engaged with and fit together with the contacting slider, on which are mounted the projections. The lock cylinder is also provided with a pressing member fixed with respect to the cylinder housing, by which the locking element in the O-position of the cylindrical core is held against the force of a compressible spring engaged to the locking element, and is pushed into an unlocking position on rotation of the cylindrical core.

9 Claims, 2 Drawing Figures

LOCK CYLINDER WITH ROTATABLE MAGNETIC TUMBLERS

FIELD OF THE INVENTION

Our present invention relates to a key-operated lock and, more particularly, to an improved lock cylinder for a key-operated lock.

BACKGROUND OF THE INVENTION

Austrian Pat. No. AT-PS 357,430 describes a lock cylinder having a cylinder housing and a cylinder core having at least one, and usually a plurality, of rotatable magnetic tumblers or rotors supported therein.

In the cylinder core at least one axially slidable locking element is also provided and has its axial position controlled by the rotatable magnetic tumblers. The locking element has at least one projection, preferably a plurality of projections, directed toward the exterior of the lock cylinder.

The inside or inner wall of the cylinder housing has at least one circular groove and a longitudinal groove, the circular grooves being so located axially that in the axially advanced position of the locking element, in which contacting elements protruding toward the inside of the lock cylinder lie in notches of the rotatable magnetic tumblers, a release of the restrained projections of the locking element allowing rotation of the cylinder core is provided.

We have found it to be desirable to reduce the forces operating during faulty or incorrect locking on the rotatable magnetic tumblers of the lock cylinder, in order to prevent possible damage to the rotatable magnetic tumblers, and to enable a reduction in the dimensions for the contacting elements and other components and thus to increase the mechanical precision of the lock. Furthermore it is also desirable to reduce the influence of the environment, including that of weather, dust, corrosive material, and the like on the circular lock, and on the components found moving on the inside of the cylinder core.

OBJECTS OF THE INVENTION

It is, therefore, an object of our invention to provide an improved lock cylinder.

It is also an object of our invention to provide an improved lock cylinder having improved mechanical precision.

It is a further object of our invention to provide an improved lock cylinder, in which the forces on the rotatable magnetic tumblers operating during lock action, especially during faulty locking, are reduced.

It is also an object of our invention to provide an improved lock cylinder, in which damage to the rotatable magnetic tumblers due to excessive forces occuring during lock action is prevented, and thus also to be able to make components of the lock cylinder whose dimensions are reduced from those of similar prior art components.

It is yet another object of our invention to provide an improved lock cylinder in which the mechanical precision of the lock is increased by providing a mechanism free from the action of corrosive materials, moisture, dust, and the like.

SUMMARY OF THE INVENTION

These objects and others which will become more apparent hereinafter are attained in accordance with our invention in a lock cylinder comprising a cylinder housing and a cylinder core having at least one rotatable magnetic tumbler supported therein, wherein in the cylinder core at least one axially slidable locking element is provided, whose slidability is controlled by the rotatable magnetic tumblers and the locking element has at least one projection directed toward the exterior of the lock cylinder.

The inside wall of the cylinder housing has at least one circular groove therein and a longitudinal groove, wherein each of the circular grooves is located axially, so that in the axially advanced position of the locking element, in which each one of the contacting elements protruding toward the interior of the lock cylinder lies in an associated notch in one of the rotatable magnetic tumblers, a release of each of the projections of the locking element allowing rotation of the cylinder core is provided.

According to our invention the locking element comprises two pieces, a contacting feeler or sensing slider from which each of the contacting, sensing or feeler elements extends toward the rotatable magnetic tumblers, and a locking slider, whose upper surface has at least one of the projections.

The contacting slider and the locking slider are engaged and fit together. A pressing member fixed with respect to the cylinder housing is provided by which the locking element in the O-position or opening position of the cylinder core is held against the force of a compressible spring engaged to the locking element, and is pushed into an unlocking position on further rotation of the cylinder core, when the correct key is used to rotate the cylinder core.

Thus by dividing the locking element into a contacting slider, whose contacting elements only bear a force as great as that provided by the compressible spring, and a more bulky locking slider, many components of the lock cylinder can be formed with comparatively smaller dimensions than those of the prior art, because they are subjected to smaller, potentially less damaging operating forces than those of the prior art.

The O-position is herein defined as that position in which the locking element, specifically the contacting elements of the contacting slider, engage the tumblers when the tumblers are properly oriented by the correct key, so that the locking element is axially advanced by the compressible spring so that it contacts and presses on the pressing member.

According to a preferred embodiment of our invention the locking slider and the contacting slider are positioned on opposite sides of a core sleeve supported rigidly in the cylinder core and sealingly abutting shoulders thereof at opposite axial ends of this sleeve. The contacting slider and the locking slider are bound to each other by at least one pin projecting through an opening in the covering core allowing the axial displacement of the two sliders in concert.

According to a further feature of our invention in the vicinity of the opening in the covering core between the locking slider and the contacting slider a sealing member is provided through which the coupling pin protrudes. This sealing member facilitates maintaining a lock operation free from corrosive materials, moisture, dust and the like which may impair the mechanical efficiency of or may damage the lock.

In an advantageous preferred embodiment of our invention the pressing member is formed on a control ring fixed with respect to rotation on the cylinder housing.

Further in another preferred embodiment of our invention the covering sleeve has guides, preferably a pair of raised edges, for the contacting slider and the locking slider.

Finally the lock cylinder of our invention is advantageously provided with four of the rotatable magnetic tumblers.

BRIEF DESCRIPTION OF THE DRAWING

The above and other objects, features, and advantages of our invention will become more readily apparent from the following specific description, reference being made to the accompanying drawing in which.

SPECIFIC DESCRIPTION

Figure 1:
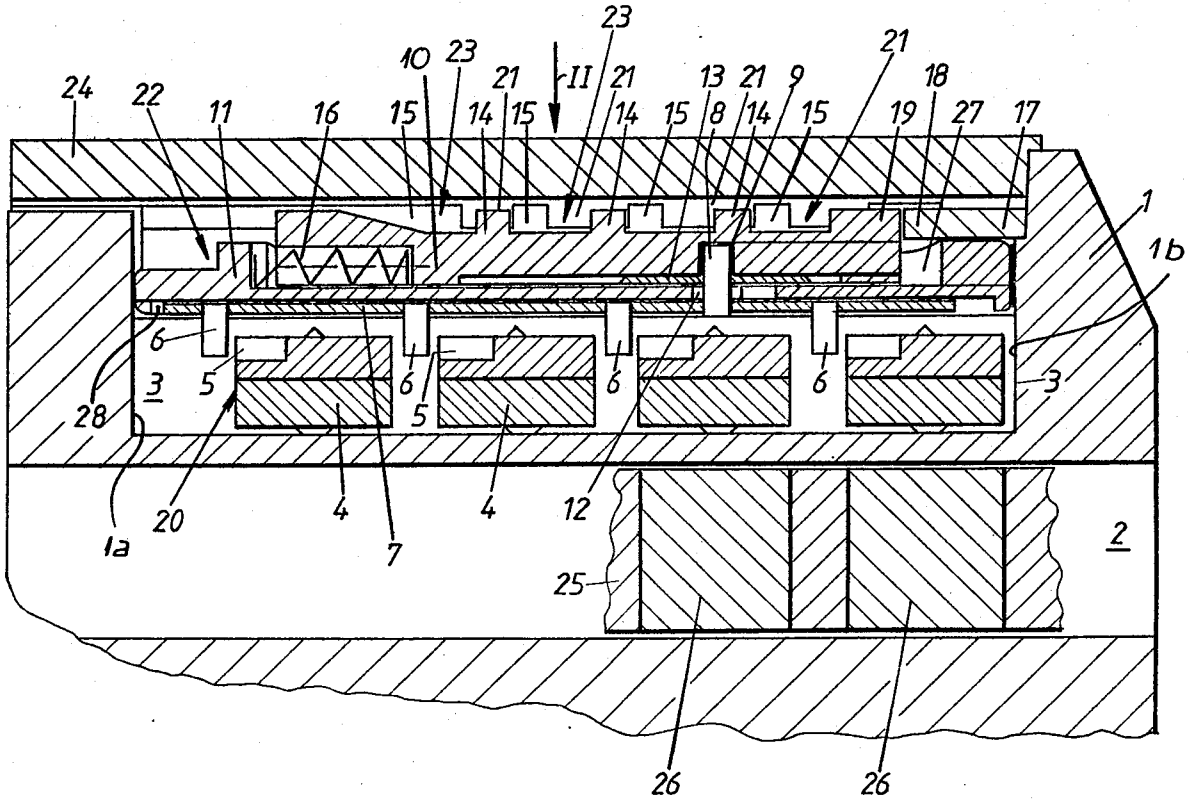
FIG. 1 is a cross-sectional view of a preferred embodiment of the lock cylinder according to our invention taken along section line I—I of FIG. 2 in a plane containing the axes of the rotatable magnetic tumblers.

The basic structure of the lock cylinder of our invention is similar to that described in Austrian Pat. No. AT-PS 357 430. In the cylinder core 1 a chamber 3 is oriented parallel to the key channel 2, in which the rotatable magnetic tumblers 4 are positioned so as to be freely rotatable. By insertion the correct key 25 (shown only in part in FIG. 1) the rotatable magnetic tumblers 4 are brought into the position shown in FIG. 1, whereby the notches 5 are aligned in such a way that the contacting elements 6 of locking element 22 can be axially shifted so as to enter the notches 5 of the rotatable magnetic tumblers 4.

Prior art locking elements are formed as a single piece and perform both the function of making contact with the tumblers 4 and also that of locking the lock cylinder against rotation. By contrast, the locking element 22 according to our invention comprises a contacting slider 7 and a locking slider 10 on opposite sides of the sleeve 11.

The contacting slider 7 can be pressed against the rotary tumblers 4 and has projecting contacting elements 6 which engage tumblers 4. On the other side of the contacting slider 7 a pin or entrainer 8 is provided. This pin 8 engages in a recess 9 in the locking slider 10, whereby both sliders are engaged with and fit together with each other.

Between both sliders as was previously noted a covering sleeve 11 is positioned, which fits tightly in the chamber 3. To provide for motion of the cam 8 the covering sleeve 11 has a slot 12 positioned so as to receive cam 8 with clearance.

For sealing of this slot 12 between the locking slider 10 and the covering core 11 a sealing member 13 is positioned, which is allowed to slide with the cam 8 over the covering core 11.

The locking slider 10 has on its upper surface the projections 14, which in a way familiar to the art are received in an axial groove 23 of the cylinder housing 24 in the O-position of the lock cylinder and therefore will slide axially with locking slider 10. The locking slider 10 can take a position in which the projections 14 align with the associated circular channels or grooves 15 of the cylinder core 1, so that the cylinder core 1 can rotate and operate the lock to which it belongs, i.e. to withdraw a bolt.

Figure 2:
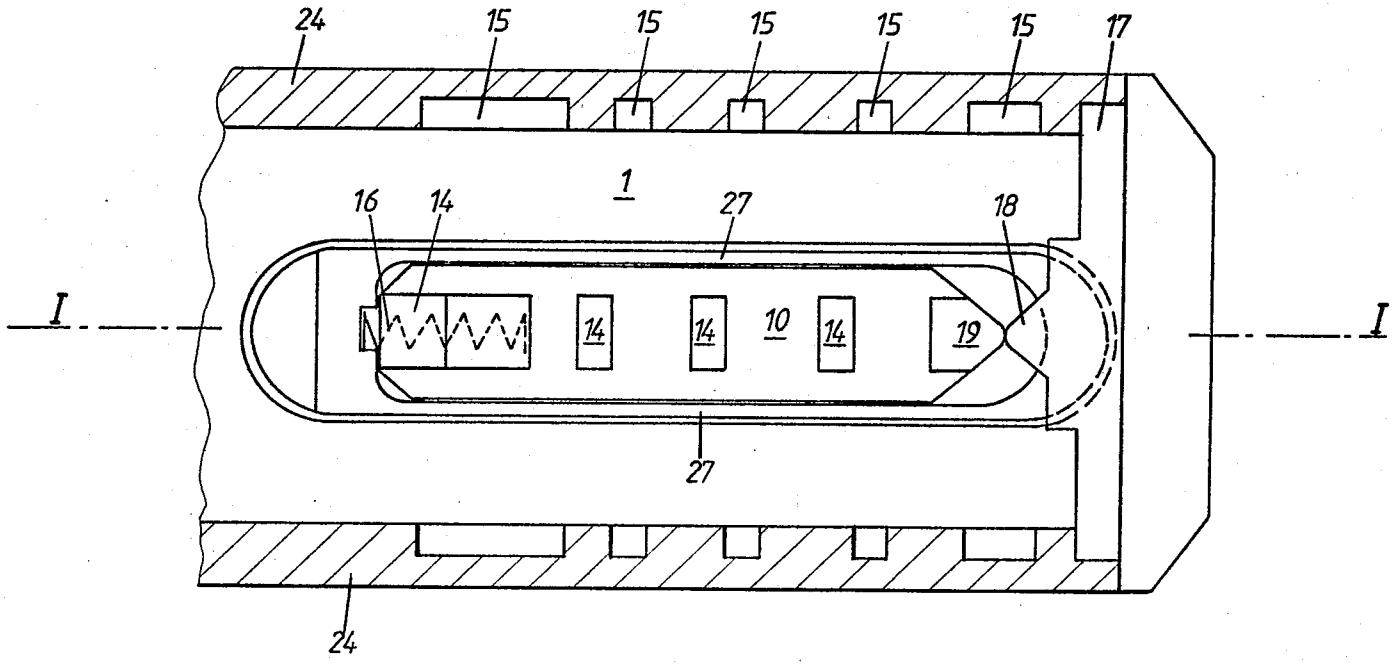
FIG. 2 is a schematic plan view of the lock cylinder of FIG. 1 as seen in the direction of the arrow II of FIG. 1.

As is apparent from FIGS. 1 and 2, the entire locking element 22, comprising contacting slider 7 and locking slider 10, is biased by a compression spring 16. The locking element 22 is thus under an applied force so that the contacting elements 6 are slid in the direction of the rotary tumblers 4. The axial sliding of the locking elements 22 is controlled by a control ring 17. The control ring 17 is attached rotationally fixed to the cylinder housing 24 and has a pressing member 18.

In the position of the cylinder core 1 shown in FIGS. 1 and 2 the pressing member 18 contacts the control nose piece 19 of the locking slider 10, and the entire locking element 22 is moved because of that into the left in FIG. 1 against the restoring force of the spring 16. The contacting elements 6 are then out-of-engagement with the rotating tumblers 4.

When the correct key is pushed into the key channel 2, the rotatable magnetic tumblers 4 as a result of the key magnets 26 take the indicated position in FIG. 1, and the cylinder core 1 rotates with the key 25, the control nose piece 19 runs below the pressing member 18 (see FIG. 2), and the locking element 22 is moved to the right by the force of the spring 16, whereby the contacting elements 6 move into the notches 5 of the rotatable magnetic tumblers 4. Because of this sliding motion the projections 14 arrive in the correct positions to enter the circular grooves 15, so that further rotation of the cylinder core 1 is now possible.

When an incorrectly structured key 25 is inserted, the rotatable magnetic tumblers 4 assume a rotary position, in which the notches 5 do not stand opposite the contacting elements 6. With a rotation of the cylinder core 1 the contacting elements 6 are pushed instead against the peripheral surfaces 20 of the rotatable magnetic tumblers 4, whereby a further sliding of the entire locking element 22 is prevented.

Hence the projections 14 do not align with the circular grooves 15, but come into contact with the locking surfaces 21 of the longitudinal or axial groove 23, the locking surfaces 21 being formed on the bridge or bar between the circular grooves 15.

The force operating on the rotatable magnetic tumblers 4 by the contacting elements 6 can only be as great as the force of the compression spring 16. This force is completely independent of the rotary force employed to turn the key 25 and must be made strong enough so that an obstruction free sliding of the contacting slider 7 is guaranteed. Because of that damage to the rotatable magnetic tumblers 4 or the control ring 17 is prevented. The parts of the contacting slider 7 as well as the parts associated with it contacting the tumblers 4 can be dimensioned so as to be thinner than those of the prior art, since they bear a reduced force. In contrast to that the locking slider 10 is formed so as to be bulky or thick, and can take the comparatively large rotary force applied by the key 25, without transferring that rotary force to the contacting slider 7.

By the tight fit of the covering sleeve 11 between the shoulders **1*a* and 1*b***, and, of the cylinder core, the sensitive interior of the lock cylinder is reliably protected against penetration by dust, moisture, vapor and the like.

In FIGS. 1 and 2 the control ring 17 is positioned on the shoulder end of the cylinder housing 24, also on the side from which the key 25 is inserted in the lock. The entire arrangement can be reversed in the lock, so that then the control ring 17 sits on the mounted end of the lock. The control ring 17 with the cylinder housing 24 can be formed in a single piece or the pressing member 18 can be set in the cylinder housing 24 as a separate component.

In FIG. 1 the rotatable magnetic tumbler structure is only indicated where the tumblers 4 are shown mounted on a side of the cylinder core 1. A similar structure can be positioned on the other side of the lock, whereby the number of combinations and the applied lock force both can be increased.

The covering core 11 can be made of plastic or metal. For the best possible sealing action it is particularly advantageous to put the covering core 11 in a press fit in the chamber 3. For precise guiding of the contacting slider 7 and the locking slider 10 the covering core 11 has on each side raised edges 27 and 28, which effect a guiding during the sliding of both sliders.

We claim:

1. In a lock cylinder comprising a cylinder housing and a cylinder core having one or more rotatable magnetic tumblers supported therein, wherein in said cylinder core at least one axially slidable locking element is provided, whose slidability is controlled by said rotatable magnetic tumblers and said locking element has at least one projection directed toward the exterior of said lock cylinder, the inside wall of said cylinder housing having one or more circular grooves and a longitudinal groove therein, wherein said circular grooves are positioned axially, so that in the axially advanced position of said locking element, in which one or more contacting elements protruding toward the interior of said lock cylinder lie in an associated notch in one of said rotatable magnetic tumblers, a release of said projections of said locking element allowing rotation of said cylindrical core is provided, the improvement wherein said locking element comprises a contacting slider from which said contacting elements extend toward said rotatable magnetic tumblers, and a locking slider, whose upper surface has at least one of said projections, engaged to and fit together with said contacting slider, and that a pressing member fixed with respect to said cylinder housing is provided, by which said locking element in the O-position of said cylinder core is held against the force of a compressible spring engaged to said locking element, and is pushed into an unlocking position on rotation of said cylinder core.

2. The improvement according to claim 1 wherein said locking slider and said contacting slider are positioned on opposite sides of a covering sleeve supported rigidly in said cylinder core, and said contacting slider and said locking slider are bound to each other by at least one pin projecting through an opening in said covering sleeve.

3. The improvement according to claim 2 wherein in the vicinity of said opening in said covering sleeve between said locking slider and said contacting slider a sealing member is provided through which said pin protrudes.

4. The improvement according to claim 3 wherein said pressing member is formed on a control ring mounted fixed in regard to rotation on said cylinder housing.

5. The improvement according to claim 4 wherein said covering sleeve has guides for said contacting slider and said locking slider.

6. The improvement according to claim 5 wherein said guides comprise a pair of raised edges.

7. The improvement according to claim 6 wherein said lock cylinder has four of said rotatable magnetic tumblers.

8. In a lock cylinder comprising a cylinder housing and a cylinder core having one or more rotatable magnetic tumblers supported therein, wherein in said cylinder core at least one axially slidable locking element is provided having one or more projections directed toward the exterior of said lock cylinder and one or more contacting elements extended toward the interior of said lock cylinder, said locking element being mounted slidably and at least partially rotatably in an axially directed longitudinal groove on the inside wall of said cylinder housing, the inside wall of said cylinder housing also having one or more circular grooves therein which is positioned axially, so that, when said locking element is slid axially into a position in which said contacting elements engage an associated notch in one of said rotatable magnetic tumblers because said rotatable magnetic tumblers are properly oriented therefor by insertion of a correctly formed key in said lock cylinder, said projections are engageable in said circular grooves, so that said locking element may be rotated further to open said lock cylinder, the improvement wherein said locking element comprises a contacting slider from which said contacting elements extend toward said rotatable magnetic tumblers, and a locking slider, whose upper surface has at least one of said projections thereon, engaged and fit together with said contacting slider, and that a pressing member fixed with respect to said cylinder housing is provided, by which said locking element in said position in which each of said contacting elements engages in each of said notches of said rotatable magnetic tumblers is held against the force of a compressible spring engaged to said locking element, and may be pushed into an unlocked position by rotation of said cylinder core, when said correctly formed key is inserted in said lock cylinder.

9. A lock cylinder, comprising:

a cylinder housing;

a cylinder core axially fixed but rotatable in said housing, said core having an outwardly open peripheral recess between a pair of axially spaced shoulders;

an axially shiftable locking member received in said recess and provided with tumbler-engaging means extending inwardly and housing-engaging means extending outwardly for controlling rotation of said core upon axial displacement of said locking member;

a cover member sealingly received in said recess between said shoulders, said locking member including an inner slider on an inner side of said cover member and provided with said tumbler-engaging means and an outer slider on an outer side of said cover member and provided with said housing-engaging means, said cover member having an opening, said sliders being coupled for joint movement by an element passing through said opening; and tumblers on said core inwardly of said inner slider and controllable by a key to enable said tumbler-engaging means to engage said tumblers and permit rotation of said core.

* * * * *